United States Patent [19]

Kahler

[11] 4,244,383

[45] Jan. 13, 1981

[54] SMOKING DEVICE

[76] Inventor: Richard W. Kahler, Box 61, Rte. #1, Rock Cave, W. Va. 26234

[21] Appl. No.: 51,167

[22] Filed: Jun. 22, 1979

Related U.S. Application Data

[63] Continuation of Ser. No. 798,490, May 19, 1977, which is a continuation-in-part of Ser. No. 527,074, Nov. 25, 1974, abandoned, which is a continuation of Ser. No. 357,186, May 4, 1973, Pat. No. 3,863,646.

[51] Int. Cl.[3] ..... A24F 1/02; A24F 5/00

[52] U.S. Cl. ..... 131/180; 131/184 A; 131/226; 131/173

[58] Field of Search ..... 131/173, 170 R, 179, 131/178, 226, 180, 171 R, 184 A, 170

[56] References Cited

FOREIGN PATENT DOCUMENTS 102619 9/1941 Sweden ..... 131/179

2844 of 1878 United Kingdom ..... 131/179

137772 1/1920 United Kingdom ..... 131/179

*Primary Examiner*—V. Millin

*Attorney, Agent, or Firm*—Schwartz & Weinrieb

[57] ABSTRACT

A smoking device comprising a reversible smoking bowl in combination with a stem of said smoking device. The reversible bowl comprises two smoking compartments in coaxial alignment with each other and with the stem. Both compartments are of the same diameter but have a different length whereby different volumes of tobacco can be used in each compartment. The smoking bowl is reversible because one compartment alternatively accommodates either the stem of the smoking device or a first charge of tobacco while the other compartment simultaneously alternatively accommodates the second charge of tobacco or the stem of said smoking device.

3 Claims, 2 Drawing Figures

SMOKING DEVICE

CROSS-REFERENCE TO RELATED APPLICATIONS

This application is a continuation of application Ser. No. 798,490, filed May 19, 1977 which is a continuation-in-part of Ser. No. 527,024 filed Nov. 25, 1974 now abandoned which is a continuation of 351,186 filed May 4, 1973 now U.S. Pat. No. 3,863,646.

BACKGROUND OF THE INVENTION

This invention relates generally to a smoking bowl for use with a smoking device and more particularly to an improved reversible smoking bowl used in combination with a stem that is part of a smoking device.

Prior art smoking bowls, are generally well known, however, such water pipes generally suffer from the disadvantages that they generally only have one-sized compartment for disposing tobacco therein for smoking purposes with the other end of the smoking bowl providing an attaching means to secure the bowl to a stem of a smoking device.

It is, therefore, a primary object of this invention to provide a new and improved smoking bowl.

An additional object of this invention is to provide a smoking bowl which is easy to clean and is capable of being reversed to accommodate either a large or small charge of tobacco, at the user's option.

Still another object of this invention is to provide a smoking bowl which is sturdy and rugged in its construction.

Yet an additional object of this invention is to provide a reversible smoking bowl which is well suited for the purpose of smoking rare and expensive tobaccos.

SUMMARY OF THE INVENTION

Briefly, in accordance with this invention, a smoking device is provided which comprises a reversible smoking bowl in combination with a stem. The reversible bowl comprises:

(a) first smoking compartment means, have a predetermined diameter and length, and defined within one end of said bowl, for receiving either a hollow stem of a smoking device in a coaxial manner, or a first charge of tobacco;

(b) second smoking compartment means, having a diameter equal to said predetermined diameter and a length greater than said predetermined length, and defined with another end of said bowl, for also receiving either a hollow stem of a smoking device in a co-axial manner, or a second charge of tobacco which is larger than the first charge of tobacco, and being co-axial with the first smoking compartment means; and (c) means defining an orifice within said bowl for connecting said first and second smoking compartment means, said orifice means being unrestricted by the stem of said smoking device so as to thereby permit smoke and ash to freely pass from one of said compartment means having tobacco disposed therein to the other one of said compartment means having a stem of a smoking device disposed therein.

The bowl is reversible since the first compartment means alternatively accommodates either a stem of a smoking device or the first charge of tobacco, while the second compartment means simultaneously alternatively accommodates the second charge of tobacco or a stem of a smoking device, each of said compartments being in co-axial alignment with each other and in co-axial alignment with that portion of the stem immediately adjacent to said reversible bowl.

DESCRIPTION OF THE EMBODIMENT

The specific nature of the invention, as well as other objects and advantages thereof will clearly be apparent from the following description and the associated drawings.

Figure 1:
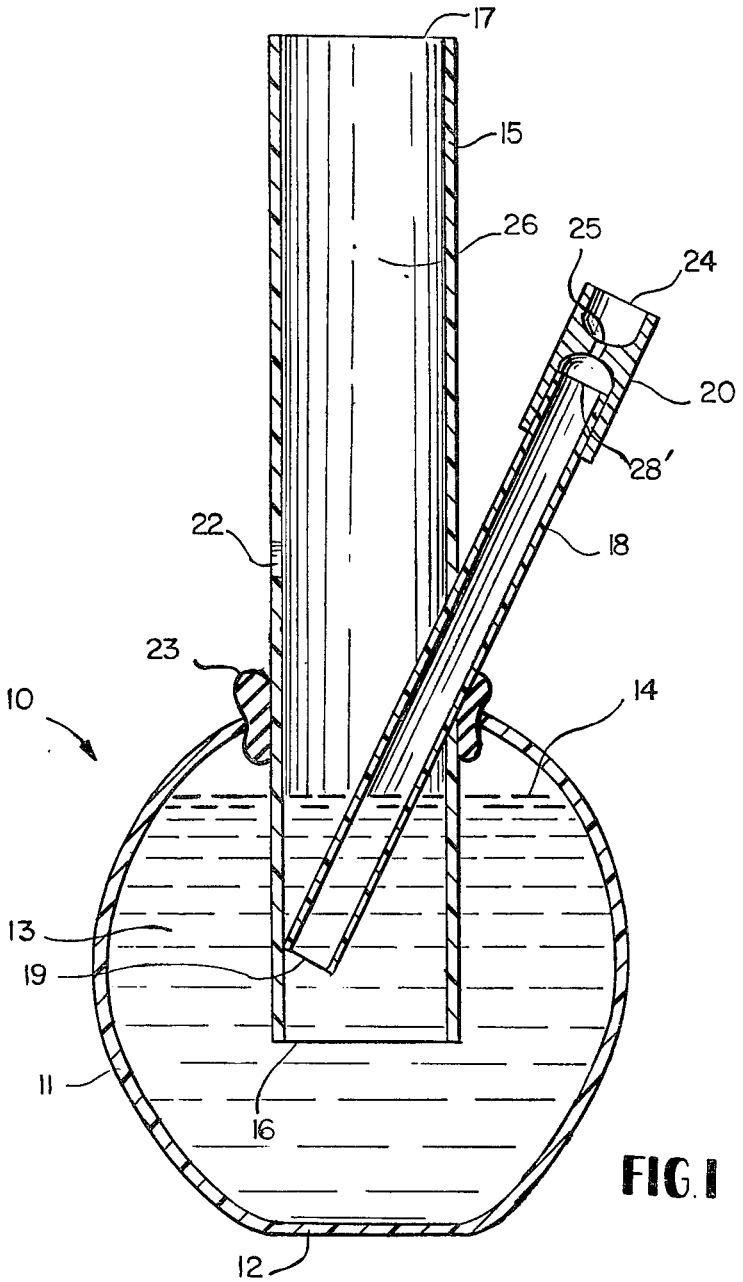
FIG. 1 illustrates a cross-sectional view of a smoking device showing the use of a reversible smoking bowl in accordance with this invention.

Referring more particularly to FIG. 1, an example of a smoking device with which the reversible bowls of this invention can be employed, is illustrated generally by the numeral 10. Chamber 11, shaped somewhat like a conventional fish bowl, is provided with a flattened base portion 12 and adapted to contain a liquid 13. This liquid may be any suitable filtering and cooling liquid such as water, however, other liquids such as wine may also be utilized. Inserted into chamber 11 is a substantially cylindrical pipe-like member 15 which is secured within chamber 11 by means of a cylindrical flexible rubber-like piece 23 which, by means of friction and pressure, retains cylindrical member 15 in a desired position with respect to chamber 11. Cylindrical member 15 extends sufficiently into chamber 11 such that open end 16 is sufficiently below the liquid level line 14. The other open end 17 of cylindrical member 15 extends outwardly from chamber 11.

A second substantially cylindrical member or stem 18, having open ends 19 and 21, also extends into chamber 11 such that open end 19 is below liquid level line 14. Reversible smoking bowl 20 is adapted to fit directly over open end 28' of cylindrical member 18, and smoking compartment 24 of bowl 20 is designed to receive the tobacco materials.

In operation, the smoking tobacco is placed within compartment 24 of smoking bowl 20 and is lit by the user. Simultaneously, the user places his mouth over open end 17 of member 15 and draws thereupon so as to create a partial vacuum in the tube 26 of member 15. Smoke from the burning tobacco is drawn through orifice 25 and continues down through cylindrical member 18 and into the liquid 13 by virtue of open end 19 of cylindrical member 18. The smoke then filters through liquid 13 and continues upward into cylindrical member 15, passing through liquid level line 14 and continuing upward until it reaches the user's mouth.

During this initial drawing period, the user maintains orifice 22 closed by means of his thumb or other appropriate means to prevent air from being drawn into the tube. Once a sufficient amount of smoke has been drawn into section 26 of member 15, the user may, at his option, permit air to be drawn in through orifice 22 and to mix with the smoke in member 15 so as to create a milder and mellower smoke mixture. This smoking pipe arrangement is particularly efficient in that most of the smoke created by the burning of the tobacco in compartment 24 ultimately ends up in area 26 of cylindrical member 15 and is entirely, at the option of the user, drawn into the user's lungs. Accordingly, little or no smoke is wasted into the atmosphere as is the case with prior art inefficient pipes.

Figure 2:
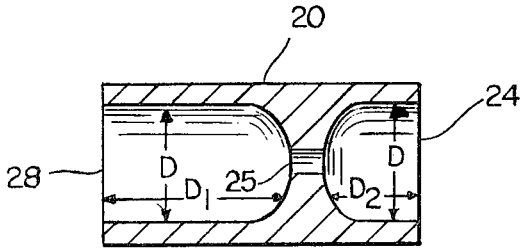
FIG. 2 shows a cross-sectional view of the reversible bowl which is the subject of this invention.

Referring now to FIG. 2, the details of reversible bowl 20 will be described. Reversible bowl 20 comprises essentially of a first smoking compartment 24 having an inside diameter D and a second smoking compartment 28 also having the same inside diameter D. The two smoking compartments are connected by an orifice 25 having the sufficient diameter to permit smoke to pass therethrough while being capable of retaining the smoking tobaccos, thereby avoiding the necessity of a conventional screen. The bowl, which is preferably made of aluminum or other suitable material, is designed to fit snugly over the open end 21 of cylindrical member 18, as illustrated in FIG. 1. It should be apparent that either compartment 24 or 28 can be made to slip over opening 28' of member 18, and that in either event, the appropriate remaining compartment becomes the smoking compartment. Thus, a single unitary device is capable of providing the user with two separate smoking bowls, both of which are in co-axial alignment and each having the same diameter, but a different length ($L_1$ or $L_2$) such that a different amount of smoking tobacco may be utilized with the same smoking pipe.

The reversible bowl 20 of this invention, as noted hereinbefore, is in co-axial alignment with that portion of stem 18 immediately adjacent said bowl 20 and preferably in coaxial alignment with the entire length of the stem. Thus, stem 18 is co-axially aligned with compartments 24 and 28, said compartments being in co-axial alignment with each other.

It is further noted that said compartments 24 and 28 are generally employed in an upwardly inclined position to retain tobacco within the compartment being used for a smoking charge wherein the angle formed by said bowl 20 with respect to a horizontal plane is between about 45° and 90°. If the bowl 20 is placed on a stem whereby said bowl 20 is at an angle somewhat less than 45°, the tobacco contained within compartment 24 would be expected to fall out and thereby not serve its intended function.

According to a preferred embodiment of this invention, stem 18 is substantially straight over its entire length whereby said entire length is in co-axial alignment with compartments 24 and 28 of said bowl 20. However, it is understood that portions of stem 18 not immediately adjacent to bowl 20, may have curves or bends therein provided that both compartments 24 and 28 of said bowl 20 are used in an upwardly inclined position so that tobacco therein will not fall out of the compartment being used in the smoking of the tobacco.

The cylindrical members 15 and 18, as well as the chamber 11 are preferably made of transparent material such as glass or suitable transparent plastics so as to enable the user to determine readily the level of liquid and smoke contained therein.

Other appropriate and suitable modifications can be made to the structure of this invention without departing from the spirit and scope of the invention claimed herein. Thus, reversible smoking bowl 20 can be adapted to fit over open end 28' of cylindrical member 18 in any of a number of well known ways, including the use of bayonet mount, conventional screw threads, simple slip-on and other well known techniques. The same applies with respect to the insertion of cylindrical member 15 within chamber 11. Any well known and appropriate securing member 15 within chamber 11 would be within the spirit and scope of this invention.

It should be apparent from the foregoing that a new and improved smoking device has been provided which is uniquely suitable for smoking rare and expensive tobaccos and which is readily adaptable to cleaning and efficient maintenance.

What is claimed is:

1. In a smoking device comprising a reversible smoking bowl in combination with a stem, said reversible bowl comprising:

(a) first smoking compartment means, having a predetermined diameter and length, and defined within one end of said bowl, for receiving either a hollow stem of a smoking device in a co-axial manner with respect to a first rectilinear axis passing longitudinally through said stem and said first compartment, or a first charge of tobacco;

(b) second smoking compartment means being larger than said first smoking compartment means, and having a diameter equal to said predetermined diameter and defined within another end of said bowl, for also receiving either a hollow stem of a smoking device in a co-axial manner with respect to a second rectilinear axis passing longitudinally through said stem and said second compartment, or a second charge of tobacco which is larger than said first charge of tobacco, and being co-axial with said first smoking compartment means as a result of said first and second axes being coincident;

(c) means defining an orifice with said bowl for connecting said first and second smoking compartment means, said orifice means being unrestricted by the stem of said smoking device so as to thereby permit smoke and ash to freely pass from one of said compartment means having tobacco disposed therein to the other one of said compartment means having a stem or a smoking device disposed therein, said bowl thereby being reversible as said first compartment means alternatively accomodates either said stem or the first charge of tobacco, while the second compartment means simultaneously alternatively accomodates the second charge of tobacco or said stem, each of said compartments being in co-axial alignment with each other through means of the coincidence of said first and second axes, and in co-axial alignment with that portion of the stem immediately adjacent to said reversible bowl through means of either said first or second axis.

2. The smoking device of claim 1 wherein said compartments are upwardly inclined to retain tobacco within said compartment accommodating said tobacco.

3. The smoking device of claim 1 wherein said reversible smoking bowl is aluminum.

* * * * *